US005503683A

United States Patent [19]

Butcher et al.

[11] Patent Number: 5,503,683

[45] Date of Patent: Apr. 2, 1996

[54] FUEL SYSTEM CLEANING APPARATUS

[75] Inventors: Edward L. Butcher, Lower Burrell, Pa.; Gordon Jones, Hudson, Ohio

[73] Assignee: Ad/Vantage Inc., New Kensington, Pa.

[21] Appl. No.: 265,827

[22] Filed: Jun. 27, 1994

[51] Int. Cl.[6] ..... B08B 9/02

[52] U.S. Cl. ..... 134/22.12; 134/22.11; 134/169 A; 134/169 C; 123/198 A

[58] Field of Search ..... 134/169 A, 166 R, 134/169 G, 57 R, 22.11, 22.12; 123/198 A; 222/71, 82

[56] References Cited

U.S. PATENT DOCUMENTS

| | | | |
|---|---|---|---|
| 4,281,775 | 8/1981 | Turner | 222/82 |
| 4,606,311 | 8/1986 | Reyes et al. . | |
| 4,671,230 | 6/1987 | Turnipseed . | |
| 4,703,728 | 11/1987 | Payne et al. | 123/198 A |
| 4,784,170 | 11/1988 | Romanelli et al. . | |
| 4,787,348 | 11/1988 | Taylor . | |
| 4,807,578 | 2/1989 | Adams et al. | 123/198 A |
| 4,917,872 | 12/1990 | Hartopp | 134/169 A |
| 5,018,645 | 5/1991 | Zinsmeyer | 222/71 |
| 5,022,364 | 6/1991 | Phillips . | |
| 5,090,377 | 2/1992 | Pearson . | |
| 5,097,806 | 3/1992 | Vataru et al. . | |
| 5,178,684 | 1/1993 | Hutchins, Sr. . | |
| 5,271,361 | 12/1993 | Flynn . | |
| 5,287,834 | 2/1994 | Flynn . | |
| 5,289,837 | 3/1994 | Betancourt . | |
| 5,295,497 | 3/1994 | Skovron . | |
| 5,344,044 | 9/1994 | Hayden et al. | 222/71 X |

FOREIGN PATENT DOCUMENTS

| | | |
|---|---|---|
| 3832338 | 9/1989 | Germany . |
| 524923 | 1/1977 | Japan . |
| 61-107987 | 5/1986 | Japan . |
| 9214916 | 9/1992 | WIPO . |

*Primary Examiner*—Frankie L. Stinson
*Attorney, Agent, or Firm*—Andrew Alexander

[57] ABSTRACT

Disclosed is an apparatus for cleaning fuel injectors used for injecting fuel into an internal combustion engine. The apparatus comprises a first means for connecting a source of cleaning fluid to a first end of said apparatus, the cleaning fluid introduced to the apparatus being pressurized; a second means for connecting a second end of the apparatus to a fuel delivery line used for delivering fuel to the injectors, the second means permitting delivery of cleaning fluid into fuel in the fuel line, the first means and second means connected by a cleaning fluid delivery conduit.

15 Claims, 1 Drawing Sheet

FUEL SYSTEM CLEANING APPARATUS

BACKGROUND OF THE INVENTION

This invention relates to fuel injectors used for injecting fuel to an internal combustion engine and more particularly, the invention relates to a method and apparatus used for delivering of fluid for cleaning carbon deposits, varnish and the like from fuel injectors.

When varnish or olefins become deposited in the fuel injector, it restricts the flow of fuel or changes the spray pattern detrimentally, interfering with engine performance. Thus, such materials must be removed to restore the engine to its original performance.

Many fuel injector cleaning devices have been suggested. However, current fuel injector cleaning systems require the disabling of the fuel pump and in many cases disconnecting the fuel supply and return line. Some systems require the removal of the injectors. This requires extensive time and special tools to accomplish and it often creates many unsafe conditions. Existing systems also require the vehicle to operate on chemicals in order to complete the cleaning process. In order to accomplish this, the cleaning chemicals must be diluted with gasoline or other fuels. This can severely reduce the effectiveness of the cleaning chemicals. Additionally, because of the complicated nature of existing mechanical assemblies, these current systems can require as many as 50–60 different parts to allow hookup to all of the different model vehicles. Finally, because some vehicles operate at extremely high fuel line pressures, this reduces the running time and the effectiveness of the cleaning operation.

U.S. Pat. No. 5,022,364, for example, discloses a method and apparatus for cleaning fuel injectors wherein the apparatus is connected to the fuel line remote from the engine compartment by removal of the fuel filter. However, in this method, the fuel line is disconnected but the fuel pump is not disconnected. Fuel is recirculated back to the fuel tank and the engine is run on the cleaning fluid. U.S. Pat. No, 5,271,361 discloses an engine conditioning apparatus and method to remove carbon deposits from fuel injectors by initially utilizing a priming pump to pump priming fuel to the engine from an external fuel source while the engine is being cranked for starting purposes. However, the engine fuel pump is then utilized to pump a combustible, carbon-removing conditioning fuel from the fuel source through the engine fuel system along a flow path that bypasses the priming pump. U.S. Pat. No. 5,287,834 discloses a method and apparatus for removing carbon deposits from fuel injectors by delivering fuel to the inlet of the engine fuel pump while the engine is cranked for starting purposes and then delivering an engine conditioning fuel which is a mixture of normal engine fuel and a carbon cleaning agent. U.S. Pat. No. 4,787,348 discloses a carbon-cleaning apparatus for diesel engines having an independent fuel-flow system including a diesel/chemical mixture fuel tank adapted to be interconnected to a diesel engine at the engine's fuel injection. An electronic control and monitoring system is used to operate the fuel-flow system during the cleaning operation of the engine. U.S. Pat. No. 4,784,170 discloses a fuel injector cleaning kit that includes a pressurized container containing fuel injector cleaning fluid and motor vehicle fuel. The kit includes instructions, hoses and adapters for connection to a plurality of different motor vehicles. Further, the kit includes a pressure regulator to control the pressure of the mixture delivered to the vehicle. Other cleaning devices and methods are disclosed in U.S. Pat. Nos. 4,606, 311; 4,671,230; 4,807,578; 5,090,377; 5,097,806; 5,178,684; 5,289,837; 5,295,497 German reference 3832-338A; Japanese Kokai 52-4923A; Japanese reference 61-107987 and WO 92/14916.

In using prior devices, the fuel pump has to be disconnected or the fuel line from the fuel tank disconnected or similar operation which is both time consuming and presents a hazard from fuel spillage. Thus, it will be seen that there is a great need for fuel injector apparatus that is efficiently adaptable to any vehicle and does not require disconnecting fuel line or fuel pump.

The present invention provides such an apparatus.

SUMMARY OF THE INVENTION

It is an object of the invention to provide a fuel system cleaning apparatus suitable for use with most types of internal combustion engines.

It is another object of the invention to provide a fuel injection cleaning apparatus for use without disconnecting fuel lines or fuel pumps.

Yet, it is another object of the invention to provide a fuel injection cleaning apparatus wherein the amount of cleaning fluid being introduced to the injectors can be regulated for maximum cleaning efficiency.

And still further, it is another object of the invention to provide a fuel injector cleaning apparatus that permits introduction of concentrated cleaning fluid into the fuel system just ahead of the injectors without disconnecting of fuel lines or pumps and which permits the amount of cleaning fluid introduced into the fuel to be varied.

These and other objects will become apparent from the drawing, specification and claims appended hereto.

In accordance with these objects, there is provided an apparatus for cleaning fuel injectors used for injecting fuel into an internal combustion engine. The apparatus comprises a first means for connecting a source of cleaning fluid to a first end of said apparatus, the cleaning fluid introduced to the apparatus being pressurized; a second means for connecting a second end of the apparatus to a fuel delivery line used for delivering fuel to the injectors, the second means permitting delivery of cleaning fluid into fuel in the fuel line, the first means and second means connected by a cleaning fluid delivery conduit.

A valve is positioned on the conduit for controlling flow of the cleaning fluid from the source of cleaning fluid into the apparatus and a pressure regulator valve is positioned on the conduit for regulating the pressure of the cleaning fluid being flowed from the source of cleaning fluid through the apparatus into the fuel delivery line, the pressure regulator valve designed to maintain the pressure of the cleaning fluid at a pressure greater than the pressure of fuel in the fuel line.

An electronic metering device is positioned on the conduit to release a controlled amount of the cleaning fluid for introduction to the fuel line to pass a mixture of the cleaning fluid and the fuel through the fuel injectors, thereby cleaning the injectors. A check valve is located on the conduit between the metering device and the first end for preventing fuel from the fuel line from entering the apparatus.

BRIEF DESCRIPTION OF THE FIGURES

The FIGURE is a schematic representation illustrating the fuel injector cleaning apparatus in accordance with the invention.

DETAILED DESCRIPTION OF THE PREFERRED EMBODIMENTS

Figure 1:
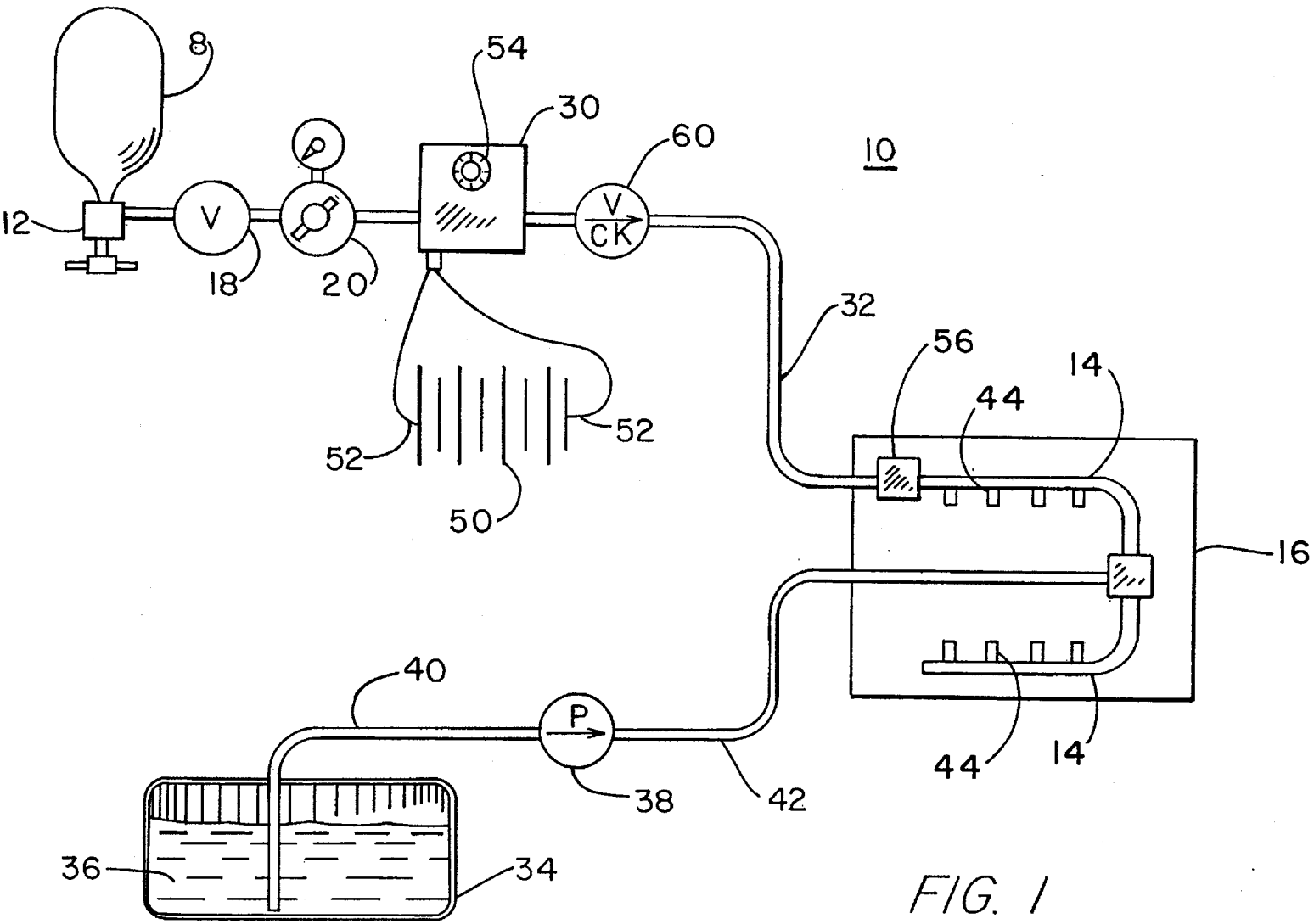

Referring now to the FIGURE, there is illustrated an exploded view of a fuel injector cleaning apparatus 10 comprising a member 12 for connecting to a supply of cleaning fluid for fuel injectors. The supply of fuel injector cleaning fluid may be provided in a pressurized container 8 in which case member 12 is provided with a can-piercing device to attach to the pressurized container without escape or loss of pressure. The pressure in the pressurized container is required to be sufficiently high to overcome the fuel pressure in rail 14 of combustion engine 16. Alternatively, fuel injector cleaning fluid can be supplied in bulk and a pump (not shown) used to pump the cleaning fluid to the required pressure. The pump may be located between member 12 and valve 18. In the fuel injector cleaning apparatus, valve 18 is an on/off valve which may be used to stop the flow of cleaning fluid until adjustments are made or until apparatus 10 is switched to another rail. If a pump is not used, member 12 may be attached directly to valve 18.

In the apparatus, valve 18 is connected to a regulator valve 20 which can be set to control the level of cleaning fluid pressure depending on the engine make and the pressure in fuel rail 14. Valve 20 should be capable of regulating cleaning fluid pressure from about 5 to 75 psi, preferably 25 to 45 psi. That is, regulator valve 20 should be capable of maintaining the cleaning fluid pressure about 1 to 10 psi and typically 3 to 5 psi above the fuel pressure in the fuel line to engine 16. It will be appreciated that different engines operate at different fuel pressures, and thus regulator valve 20 must be adjustable to accommodate the different pressures.

Regulator valve 20 is connected to a metering device 30 which meters the release of cleaning fluid to be injected into engine fuel. In the embodiment shown in the FIGURE, the cleaning fluid is shown being injected into rail 14 through tube 32. Engine fuel is shown being supplied from fuel tank 34 having engine fuel 36. Engine fuel is pumped by fuel pump 38 along lines 40 and 42 from tank 34 to rail 14. Rail 14 supplies fuel to injection nozzles 44. Thus, in the present invention, cleaning fluid is mixed with engine fuel in rail 14 to provide a mixture that is carried through injector nozzles 44. In this way, the cleaning fluid operates to remove foreign matter such as carbon deposits and varnish from the injector nozzles, thereby restoring said nozzles to their original condition. While the cleaning fluid is shown being introduced into rail 14, it may be introduced anywhere along fuel line 42.

In accordance with the present invention, metering device 30 may be any metering device that can control or regulate the amount of cleaning fluid being released into the engine fuel. Further, preferably, metering device 30 is adjustable to increase or decrease the amount of cleaning fluid introduced into the engine fuel, depending to some extent on the condition of the fuel injectors being treated.

For example, if engine 16 is operating poorly, it may require that a higher concentration of cleaning fluid be introduced into the engine fuel. If the treatment is for routine maintenance, a lower concentration of cleaning fluid may be introduced to the engine fuel. Preferably, metering device 30 is an electronically controlled metering device. Such device can conveniently be powered by automotive battery 50 to which leads 52 are connected. In operation, an electronically controlled metering device pulses a controlled number of times per second to release cleaning fluid into the engine fuel. The amount of cleaning fluid desired can be regulated by adjusting dial 54 which increases or decreases the pulses and consequently the amount of concentrate released. Such an electronically controlled metering device is available from Ad/Vantage Automotive Speciality Products, Inc., P.O. Box 4217, New Kensington, Pa. 15068, under the designation EMD801. A mechanically operated metering device may also be used.

The electronic metering device is comprised of two parts. One part is a metering value and the other part is an adjustable electronic timing device. The metering valve and electronic timing device are designed to be assembled to provide said electronic metering device. The metering valve is available from Automatic Valve, Novi, Mich., under the designation K0222-GAXR-DA, and the electronic timing device is available from Canfield Connector, Youngstown, Ohio, under the designation 5853-910A3.

In the present invention, it is preferred that cleaning fluid be released into the engine fuel to provide a mixture containing 5 to 35% (by volume) cleaning fluid, preferably 10 to 30% (by volume) cleaning fluid, the remainder engine fuel. While these are the preferred ranges, it will be appreciated that the concentration ranges of the mixtures can be extended, provided that the engine will operate on the mixture. It should be noted that the limiting factor with respect to the concentration of cleaning fluid in the engine fuel is the ability of the engine to operate. If the cleaning fluid is of the type that it will not readily support combustion in the engine, then it requires the presence of higher concentrations of engine fuel. If the cleaning fluid is of the type that would support combustion in the engine, then the amount of engine fuel present or introduced into the mixture can be reduced or even stopped. That is, the pressure of the cleaning fluid being introduced through the apparatus can be sufficiently high to substantially overcome engine fuel being introduced in order that the engine can be operated on the cleaning fluid. Further, while the cleaning operated normally takes place while the engine is operating, the present invention contemplates introduction of cleaning fluid to rail 14 while the engine is not running. Such operation contemplates introduction of cleaning fluid to rail 14 where it mixes with engine fuel and by convection reaches injector nozzles where the cleaning fluid can remove carbon deposits and varnish.

In the present invention, preferably a check valve 60 is placed between metering device 30 and rail 14. Check valve 60 operates to prevent engine fuel from entering apparatus 10, for example, the pressure of the engine fuel is higher than that in apparatus 10.

The present invention has the advantage that the cleaning fluid can be concentrated or even be entirely formulated out of cleaning fluid for more rapid and efficient cleaning of the injector nozzles. However, if desired, the cleaning fluid may be diluted, but this is used on a less preferred basis because it does not clean the injector nozzles as efficiently. When the cleaning fluid is not diluted, cleaning can be effected in a shorter time because of the higher concentration.

The invention has a further advantage compared to prior fuel injector cleaning apparatus in that the fuel pump or fuel lines do not have to be disconnected. This greatly reduces the time period to service an automobile. In prior fuel injector cleaning apparatus, it was not unusual for the service period to range from 0.75 to 1 hour. The present invention permits the service to be performed in 0.25 hour or less.

The present invention has the advantage that it permits conservation of resources. That is, after the engine has been treated to remove deposits from the fuel injector nozzles, the cleaning fluid can be easily stopped while the engine continues to operate. Thus, determination can be made with ease as to whether further cleaning is necessary. That is, it is not necessary to reconnect the fuel pump or fuel lines to determine if the cleaning has been effective.

Yet, the invention has another advantage that permits the fuel injector cleaning apparatus to be used with gasoline or diesel engines because the cleaning fluid does not have to be mixed with fuel prior to being introduced to the fuel rail.

The fuel injector cleaning apparatus can be used with any commercial fuel injector cleaning fluid. Typical cleaners include Fine-Tune, available from Champion Spark Plug Company; Fuel Injector Cleaner, available from 3M Company; Super Shock, available from Castle Products; Fuel Injector Cleaner, available from Echlin, Inc.; and Fuel System Cleaner, available from Penray.

In operation, the fuel injector cleaning apparatus 10 is connected to rail 14 utilizing a Schrader valve located on the rail. Apparatus 10 is provided with a threaded connector 56 that threads onto the Schrader valve. On connection, check valve 60 prevents engine fuel from further entering the apparatus. If a pressurized can of cleaning fluid is used, it is attached to member 12 which automatically pierces and seals the can to the apparatus. Valve 18 usually is maintained in the off position until pressure regulator 20 is pre-set, depending on the automotive model and the fuel pressure developed in rail 14. After the engine has been started, valve 18 is switched to the open position and electronic metering device started to inject controlled amounts of cleaning fluid into rail 14. As noted earlier, apparatus 10 may be stopped periodically to determine if the cleaning has been effective.

It will be noted that the apparatus has the further advantage that it can be connected and disconnected from the Schrader valve without spillage of engine fuel which is desirable both for safety and environmental purposes.

While the invention has been described in terms of preferred embodiments, the claims appended hereto are intended to encompass other embodiments which fall within the spirit of the invention.

What is claimed is:

1. An apparatus for cleaning fuel injectors used for injecting fuel into an internal combustion engine, said engine having fuel delivery thereto by a fuel pump for pumping fuel along a fuel line to injectors, the apparatus designed for use without disabling fuel delivery to the engine, the apparatus comprising:

(a) a first means for connecting a source of cleaning fluid to a first end of said apparatus, the cleaning fluid introduced to said apparatus being pressurized using one of a pressurized container or a pump independent of said fuel pump;

(b) a second means for connecting a second end of said apparatus to a fuel delivery line used for delivering fuel to said injectors, said second means permitting delivery of cleaning fluid into fuel in said fuel line, said first means and second means connected by a cleaning fluid delivery conduit;

(c) a valve positioned on said conduit for controlling flow of said cleaning fluid from said source of cleaning fluid into said apparatus;

(d) a pressure regulator valve positioned on said conduit for regulating the pressure of said cleaning fluid being flowed from said source of cleaning fluid through said apparatus into said fuel delivery line, the pressure regulator valve regulating the pressure of said cleaning fluid at a pressure greater than pressure of fuel in said fuel line;

(e) a metering device positioned on said conduit that releases a controlled amount of said cleaning fluid for introduction to said fuel line to pass a mixture of said cleaning fluid and said fuel through said fuel injectors thereby cleaning said injectors; and (f) a check valve located on said conduit between said metering device and said first end for preventing fuel from said fuel line from entering said apparatus.

2. The apparatus in accordance with claim 1 wherein said first means includes a can piercing and sealing means.

3. The apparatus in accordance with claim 1 wherein said second means is a threaded connector that threads to a valve on one of said fuel lines and fuel rail.

4. The apparatus in accordance with claim 1 wherein said pressure regulator valve is capable of regulating pressure between 5 and 75 psi.

5. The apparatus in accordance with claim 1 wherein said pressure regulator valve is capable of regulating pressure between 25 and 45 psi.

6. The apparatus in accordance with claim 1 wherein the metering device is an electronic metering device.

7. The apparatus in accordance with claim 6 wherein the electronic metering device is battery powered.

8. The apparatus in accordance with claim 1 wherein said metering device is capable of releasing cleaning fluid into said fuel line to provide a mixture comprising 5 to 35% (by volume) cleaning fluid, the remainder engine fuel.

9. The apparatus in accordance with claim 1 wherein said metering device is capable of releasing cleaning fluid into said fuel line to provide a mixture comprising 10 to 30% (by volume) cleaning fluid, the remainder engine fuel.

10. An apparatus for cleaning fuel injectors used for injecting fuel into an internal combustion engine, said engine having fuel delivery thereto by a fuel pump for pumping fuel along a fuel line to injectors, the apparatus comprising:

(a) a first means for connecting a source of cleaning fluid to a first end of said apparatus, the cleaning fluid introduced to said apparatus being pressurized using one of a pressurized container or a pump independent of said fuel pump;

(b) a threaded second means for connecting a second end of said apparatus to a fuel delivery line having a threaded valve, the line used for delivering fuel to said injectors, said second means permitting delivery of cleaning fluid into fuel in said fuel line, said first means and second means connected by a cleaning fluid delivery conduit;

(c) a valve positioned on said conduit for controlling flow of said cleaning fluid from said source of cleaning fluid into said apparatus;

(d) a pressure regulator valve, operable between 5 and 75 psi, positioned on said conduit for regulating the pressure of said cleaning fluid being flowed from said source of cleaning fluid through said apparatus into said fuel delivery line, the pressure regulator valve regulating the pressure of said cleaning fluid at a pressure greater than pressure of fuel in said fuel line;

(e) an adjustable, electronic metering device positioned on said conduit for adjustably releasing a controlled amount of said cleaning fluid for introduction to said fuel line to pass a mixture comprising 5 to 35% (by volume) of said cleaning fluid and said fuel through said fuel injectors thereby cleaning said injectors; and (f) a check valve located on said conduit between said metering device and said first end for preventing fuel from said fuel line from entering said apparatus.

11. A method for cleaning fuel injectors used for injecting fuel into an internal combustion engine, said engine having fuel delivery thereto by a fuel pump for pumping fuel along a fuel line to injectors, the method comprising:

(a) connecting a source of pressurized cleaning fluid to a first end of an apparatus for delivering said cleaning fluid to a fuel line used for transferring fuel to said connectors;

(b) maintaining said source of pressurized cleaning fluid at a pressure greater than pressure of said fuel in said line;

(c) connecting a second end of said apparatus to said fuel delivery line used for delivering fuel to said injectors, said second means permitting delivery of cleaning fluid into fuel in said fuel line, said first means and second means connected by a cleaning fluid delivery, conduit;

(d) operating said internal combustion engine by using a fuel pump to pump engine fuel through said fuel delivery lines;

(e) flowing said cleaning fluid from said source of cleaning fluid into said apparatus;

(f) regulating the pressure of said cleaning fluid being flowed from said source of cleaning fluid through said apparatus into said fuel delivery line, the pressure being regulated to a pressure greater than the pressure of fuel in said fuel line; and (g) metering the flow of said cleaning fluid into said fuel line to pass a mixture comprising 5 to 35% (by volume) of said cleaning fluid and said fuel through said fuel injectors thereby cleaning said injectors, the cleaning being achieved without disconnecting or disabling said fuel pump or fuel delivery lines from said engine.

12. The method in accordance with claim 11 including the step of regulating said pressure to a pressure in the range of 5 to 75 psi.

13. The method in accordance with claim 11 including the step of regulating said pressure to a pressure in the range of 25 to 45 psi.

14. The method in accordance with claim 11 including metering the flow of said cleaning fluid using a battery powered, electronic metering device.

15. The method in accordance with claim 11 wherein the mixture comprises 10 to 30% (by volume), the balance engine fuel.

* * * * *